US009386678B2

(12) United States Patent
Yagi et al.

(10) Patent No.: US 9,386,678 B2
(45) Date of Patent: Jul. 5, 2016

(54) PLASMA GENERATOR AND PLASMA GENERATING DEVICE

(75) Inventors: Takashige Yagi, Kagoshima (JP); Hiroshi Makino, San Diego, CA (US); Tetsuya Tojo, Kagoshima (JP); Takahito Hirata, Kagoshima (JP)

(73) Assignee: KYOCERA Corporation, Kyoto (JP)

( * ) Notice: Subject to any disclaimer, the term of this patent is extended or adjusted under 35 U.S.C. 154(b) by 53 days.

(21) Appl. No.: 14/125,799

(22) PCT Filed: Jun. 15, 2012

(86) PCT No.: PCT/JP2012/065365

§ 371 (c)(1),
(2), (4) Date: Dec. 12, 2013

(87) PCT Pub. No.: WO2012/173229

PCT Pub. Date: Dec. 20, 2012

(65) Prior Publication Data

US 2014/0117834 A1 May 1, 2014

(30) Foreign Application Priority Data

Jun. 16, 2011 (JP) ..... 2011-134090

(51) Int. Cl.

| | |
|---|---|
| ***H01J 17/26*** | (2012.01) |
| ***H01J 61/28*** | (2006.01) |
| ***H05H 1/24*** | (2006.01) |
| ***H01T 23/00*** | (2006.01) |

(52) U.S. Cl.

CPC ..... *H05H 1/2406* (2013.01); *H01T 23/00* (2013.01); *H05H 2001/2418* (2013.01); *H05H 2001/2437* (2013.01)

(58) Field of Classification Search

CPC ..... H05H 1/2406–2001/2468; H01T 23/00
USPC ..... 313/582, 586, 609, 231.31
See application file for complete search history.

(56) References Cited

U.S. PATENT DOCUMENTS 5,185,132 A * 2/1993 Horiike ..... H01J 37/32018 118/720
6,084,350 A 7/2000 Ezaki et al.
6,460,482 B1 * 10/2002 Kuibira ..... C23C 16/455 118/723 E (Continued)

FOREIGN PATENT DOCUMENTS

JP H11-8042 A 1/1999
JP 2008-108720 A 5/2008

(Continued)

OTHER PUBLICATIONS

International Search Report dated Sep. 18, 2012, issued for International Application No. PCT/JP2012/065365.

*Primary Examiner* — Anne Hines
*Assistant Examiner* — Jose M Diaz
(74) *Attorney, Agent, or Firm* — Procopio, Cory, Hargreaves & Savitch LLP

(57) ABSTRACT

The plasma generator has the dielectric having the inner circumferential surface, and a pair of electrodes which are arranged separated from each other in the direction along the inner circumferential surface and are isolated from each other by the dielectric and which are capable of generating plasma on the inner circumferential surface by application of voltage. In the inner circumferential surface, at the positions between the pair of electrodes in a plan view, recessed portions causing electric field concentration are formed.

5 Claims, 13 Drawing Sheets

(56) References Cited

U.S. PATENT DOCUMENTS

| | | | | |
|---|---|---|---|---|
| 7,477,017 | B2 * | 1/2009 | Eden et al. | 313/582 |
| 7,543,546 | B2 * | 6/2009 | Shibata et al. | 118/723 E |
| 7,632,379 | B2 * | 12/2009 | Goto et al. | 156/345.44 |
| 7,638,103 | B2 * | 12/2009 | Miki et al. | 422/186.04 |
| 7,892,611 | B2 * | 2/2011 | Swallow | H05H 1/2406 118/723 E |
| 7,938,707 | B1 * | 5/2011 | Walker et al. | 445/23 |
| 9,117,616 | B2 * | 8/2015 | Sohn | H01T 19/04 |
| 2003/0070760 | A1 * | 4/2003 | Kim | H01J 37/32009 156/345.43 |
| 2004/0200932 | A1 | 10/2004 | Scott et al. | |
| 2005/0016456 | A1 | 1/2005 | Taguchi et al. | |
| 2006/0042545 | A1 * | 3/2006 | Shibata et al. | 118/722 |
| 2006/0055325 | A1 * | 3/2006 | Hirota | H01J 11/40 313/587 |
| 2006/0196762 | A1 * | 9/2006 | Miki et al. | 204/157.3 |
| 2007/0017636 | A1 * | 1/2007 | Goto et al. | 156/345.47 |
| 2007/0037408 | A1 * | 2/2007 | Tachibana | C23C 16/0245 438/778 |
| 2007/0119828 | A1 * | 5/2007 | Kondo et al. | 219/121.52 |
| 2010/0320916 | A1 * | 12/2010 | Yagi | B01J 19/088 315/111.21 |
| 2014/0217882 | A1 * | 8/2014 | Yagi | H05H 1/2406 313/268 |

FOREIGN PATENT DOCUMENTS

| | | | |
|---|---|---|---|
| JP | 2008-293925 | A | 12/2008 |
| JP | 2011-108615 | A | 6/2011 |
| JP | 2012-038587 | A | 2/2012 |
| JP | 2012-102693 | A | 5/2012 |
| WO | 03/071839 | A1 | 8/2003 |
| WO | 2010/058648 | A1 | 5/2010 |

* cited by examiner

PLASMA GENERATOR AND PLASMA GENERATING DEVICE

TECHNICAL FIELD

The present invention relates to a plasma generator and a plasma generating device.

BACKGROUND ART

Plasma generators are utilized for apparatuses for reforming gases, light sources, ion wind generating devices, and other various uses. Patent Literature 1 discloses a plasma generator (more specifically, an ion wind generator) which has a dielectric and a pair of electrodes which are buried in the dielectric separated from each other in a direction along a predetermined surface of the dielectric. In this plasma generator, by application of voltage to the pair of electrodes, plasma is generated on the predetermined surface of the dielectric.

CITATIONS LIST

Patent Literature

Patent Literature 1: Japanese Patent Publication No. 2008-293925A

SUMMARY OF INVENTION

Technical Problem

In a plasma generator, from the viewpoint of reduction of the consumed power and so on, reduction of the voltage which is applied to the pair of electrodes is desired. As a method for meeting such a demand, there can be mentioned the method of making the dielectric which covers the electrodes thinner or of making the distance between the pair of electrodes shorter. In such a method, however, there are various inconveniences such as a higher possibility of occurrence of breakdown. Accordingly, it is desired to provide a plasma generator and plasma generating device capable of reducing the applied voltage by another method.

Solution to Problem

A plasma generator according to one aspect of the present invention has a dielectric having a predetermined surface, and a pair of electrodes which are arranged separated from each other in a direction along the predetermined surface and are isolated from each other by the dielectric and which are capable of generating plasma on the predetermined surface when a voltage is applied thereto. The predetermined surface is provided with a recessed portion at a position between the pair of electrodes in a plan view.

A plasma generating device according to one aspect of the present invention has a dielectric having a predetermined surface, a pair of electrodes which are arranged separated from each other in a direction along the predetermined surface and are isolated from each other by the dielectric, and a power source which is capable of generating plasma on the predetermined surface by applying a voltage to the pair of electrodes. The predetermined surface is provided with a recessed portion at a position between the pair of electrodes in a plan view.

Advantageous Effects of Invention

According to the above configuration, the applied voltage can be made lower.

DESCRIPTION OF EMBODIMENTS

Below, plasma generators and plasma generating devices according to a plurality of embodiments of the present invention will be explained with reference to the drawings. Note that, the drawings used in the following explanation are schematic ones, and dimensions, ratios, etc. on the drawings do not always coincide with the real ones.

The configurations the same or similar to each other will be sometimes expressed by attaching ordinal numbers to the terms and adding capital letters of the alphabet to the notations, for example, as in the "first insulation layer 7A" and "second insulation layer 7B". Further, sometimes the ordinal numbers and capital letters of the alphabet will be omitted and the configurations will be simply referred to as the "insulation layers 7" without distinguishing between them.

In the second and following embodiments, for configurations which are common with or similar to those of the already explained embodiments, sometimes notations common to those in the already explained embodiments will be used, and illustrations and explanations will be omitted.

<First Embodiment>

Figure 1A:
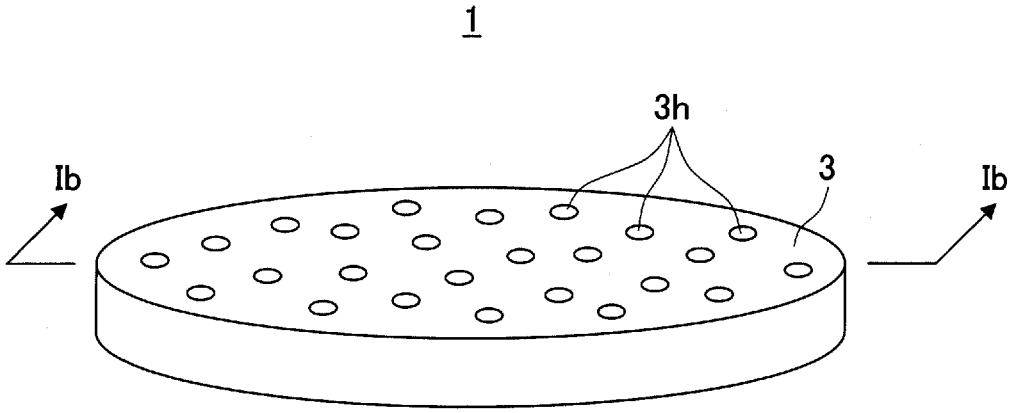
FIG. 1A is a schematic perspective view which shows an appearance of a plasma generator according to a first embodiment of the present invention.
Figure 1B:
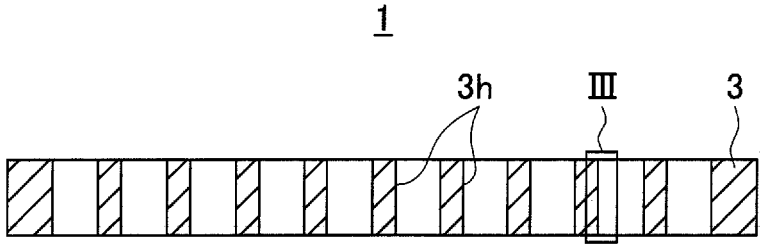
FIG. 1B is a schematic cross-sectional view which is taken along a line 1*b*-1*b* in FIG. 1A.

FIG. 1A is a schematic perspective view which shows an appearance of a plasma generator 1 according to a first embodiment of the present invention, and FIG. 1B is a schematic cross-sectional view which is taken along a line 1*b*-1*b* in FIG. 1A.

The plasma generator 1 has a dielectric 3 which is formed in roughly flat plate shape. In the dielectric 3, a plurality of through holes 3*h* which pass through the thickness direction thereof are formed. The planar shapes of the dielectric 3 and through holes 3*h* may be suitably set. In FIG. 1, however, a case of circles is exemplified. The plurality of through holes 3*h* are for example formed so that they have the same shapes and sizes as each other and are roughly equally distributed over the dielectric 3.

Figure 2:
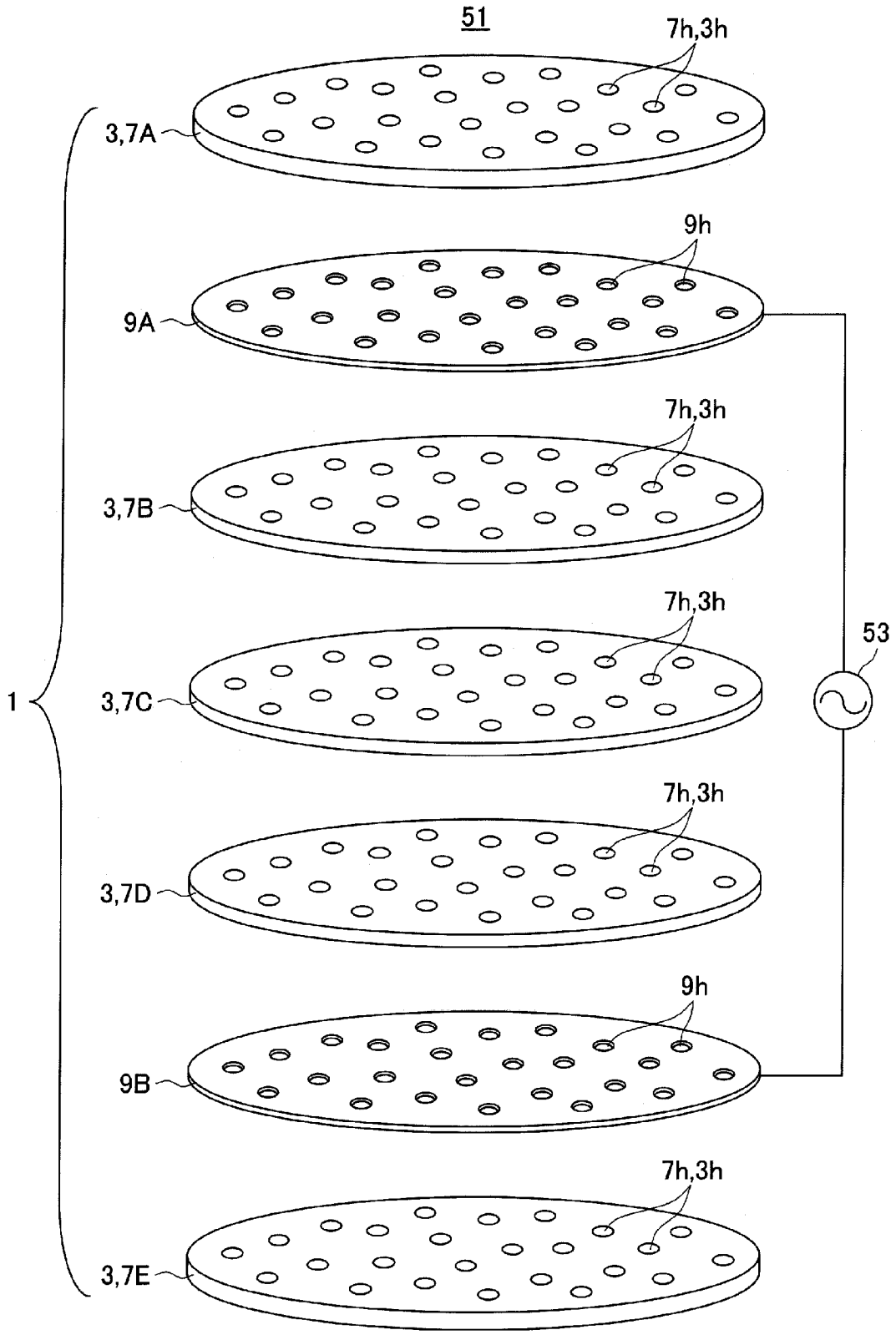
FIG. 2 A disassembled perspective view of the plasma generator in FIG. 1.

FIG. 2 is a disassembled perspective view of the plasma generator 1.

The plasma generator 1 has a plurality of insulation layers 7 which configure the dielectric 3 and a pair of electrodes 9 which are arranged among the insulation layers 7. Note that, the plasma generator 1, other than these, has interconnects etc. for connecting the electrodes 9 and the outside of the dielectric 3, but the illustration is omitted.

Further, a plasma generating device 51 is configured by including the plasma generator 1 and a power source 53 for applying voltage to the pair of electrodes 9. Note that, the plasma generating device 51, other than these, may have a control device for controlling voltage etc. which is applied from the power source 53 to the electrodes 9, member/device for introducing gas into the plasma generator 1 or discharging the plasma of the plasma generator 1, and so on.

Each insulation layer 7 is formed in for example a flat plate shape (board shape) with a constant thickness. The contours (outer edges) of the insulation layers 7 have for example roughly the same shapes and sizes relative to each other. Further, the plurality of insulation layers 7 are stacked to form the dielectric 3. The number of the plurality of insulation layers 7 and the thickness of each insulation layer 7 may be suitably set in accordance with the positions of arrangement of the electrodes 9 and so on.

In each insulation layer 7, a plurality of through holes 7*h* are formed. By stacking of the plurality of insulation layers 7 and superimposition of the plurality of through holes 7*h*, the through holes 3*h* of the dielectric 3 are configured.

The insulation layers 7 may be formed by an inorganic insulating material or may be formed by an organic insulating material. As the inorganic insulating material, for example ceramic and glass can be mentioned. As the ceramic, for example an aluminum oxide sintered body (alumina ceramic), glass ceramic sintered body (glass ceramic), mullite sintered body, aluminum nitride sintered body, cordierite sintered body, and silicon carbide sintered body can be mentioned. As the organic insulating material, for example polyimide, epoxy, and rubber can be mentioned. The plurality of insulation layers 7 are basically formed by materials the same as each other, but may be formed by materials different from each other as well.

Each electrode 9 is formed in for example a flat plate shape (layer shape) with a constant thickness. The contour (outer edge) thereof is for example made one roughly similar to the contour of the insulation layers 7. Further, it is formed a bit smaller than the contour of the insulation layers 7. Further, the pair of electrodes 9 are buried in the dielectric 3 and are isolated from each other by the dielectric 3 due to their arrangement among the plurality of insulation layers 7. In the example of FIG. 2, the pair of electrodes 9 are isolated by the second insulation layer 7B to fourth insulation layer 7D, and their outer sides are covered by the first insulation layer 7A and fifth insulation layer 7E.

In each electrode 9, a plurality of openings 9*h* are formed at positions which correspond to the plurality of through holes 3*h*. Due to this, the through holes 3*h* pass through the dielectric 3 without being obstructed by the electrodes 9. In each electrode 9, the plurality of openings 9*h* are for example formed in the same shapes and sizes as each other.

The electrodes 9 are formed by conductive material such as metal. As the metal, there can be mentioned for example tungsten, molybdenum, manganese, copper, silver, gold, palladium, platinum, nickel, cobalt, or an alloy containing these as principal ingredients.

The power source 53 applies an AC voltage to the pair of electrodes 9. The AC voltage which is applied to the electrodes 9 by the power source 53 may be a voltage which is represented by a sine wave etc. and continuously changes in potential or may be a voltage which is a pulse state and discontinuously changes in potential. Further, the AC voltage may be a voltage which fluctuates in potential relative to the reference potential at both of the pair of electrodes 9 or may be a voltage which fluctuates in potential relative to the reference potential only on one side since the other of the pair of electrodes 9 is connected to the reference potential. The fluctuation of the potential may be fluctuation to both of the positive and negative sides relative to the reference potential or may be fluctuation to only one of the positive or negative sides relative to the reference potential.

Note that, the dimensions of the dielectric 3 and electrodes 9 and the magnitude and frequency of the AC voltage may be suitably set in accordance with the technical field to which the plasma generating device 51 (plasma generator 1) is applied, the required quantity of plasma, and another various matters.

Figure 3:
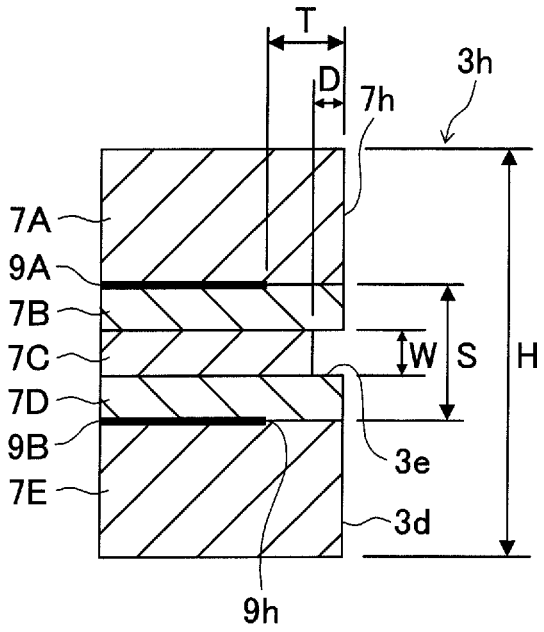
FIG. 3 An enlarged view of a region III in FIG. 1.

FIG. 3 is an enlarged view of a region III in FIG. 1.

The through holes 7*h* of the first insulation layer 7A, second insulation layer 7B, fourth insulation layer 7D, and fifth insulation layer 7E are formed in the same shapes and sizes as each other. On the other hand, the through holes 7*h* of the third insulation layer 7C are formed so that the diameters are larger than those of the through holes 7*h* of the other insulation layers 7. Accordingly, in the inner circumferential surfaces 3*d* of the through holes 3*h* configured by these plurality of through holes 7*h*, recessed portions 3*e* are formed.

Further, the openings 9*h* of the electrodes 9 are formed so that the diameters are larger than those of the through holes 7*h* of the first insulation layer 7A, second insulation layer 7B, fourth insulation layer 7D, and fifth insulation layer 7E. Accordingly, the electrodes 9 are not exposed at the interiors of the through holes 7*h*. Note that, the opening 9*h* of the first electrode 9A and the opening 9*h* of the second electrode 9B are for example formed in the same shapes and same sizes as each other.

The recessed portions 3*e* for example extend around the inner circumferential surfaces of the through holes 3*h* with a constant width W and a constant depth D. That is, the recessed portions 3*e* are formed in groove shapes. The width W is for example shorter than an inter-electrode distance S between the pair of electrodes 9, so the recessed portions 3*e* is between the pair of electrodes 9. Further, the depth D is for example smaller than a depth T from the inner circumferential surfaces 3*d* to the electrodes 9.

Note that, the width W can be adjusted within a range from a size less than the inter-electrode distance S to a size exceeding the inter-electrode distance S by adjusting the thickness of the third insulation layer 7C or making the diameter of the through holes 7*h* in the other insulation layers (7B, 7D etc.)

larger or the like. The depth D can be adjusted by adjustment of the diameter of the through holes 7*h*.

When taking as an example a case where the dielectric 3 is configured by a ceramic sintered body, the method of production of the plasma generator 1 is as follows.

First, ceramic green sheets which form the insulation layers 7 are prepared. A ceramic green sheet is formed by for example forming a slurry into a sheet shape by the doctor blade method, calendar roll method, or the like. The slurry is prepared by adding a suitable organic flux or solvent to a powder of the starting material and mixing. The powder of the starting material, when taking as an example an alumina ceramic, is comprised of alumina ($Al_2O_3$), silica ($SiO_2$), calcia (CaO), magnesia (MgO), etc.

Next, on the ceramic green sheet, a conductive paste which forms the electrodes 9 is provided. Specifically, a conductive paste which forms the first electrode 9A is provided on the surface of the ceramic green sheet which forms the first insulation layer 7A on the second insulation layer 7B side or on the surface of the ceramic green sheet which forms the second insulation layer 7B on the first insulation layer 7A side. Further, a conductive paste which forms the second electrode 9B is provided on the surface of the ceramic green sheet which forms the fifth insulation layer 7E on the fourth insulation layer 7D side or on the surface of the ceramic green sheet which forms the fourth insulation layer 7D on the fifth insulation layer 7E side.

The conductive paste is prepared by adding an organic solvent and organic binder to metal powder such as a tungsten, molybdenum, copper or silver and mixing. To the conductive paste, a dispersant, plasticizer, or the like may be added according to need as well. The mixing is carried out by a kneading means such as a ball mill, triple roll mill or planetary mixer. Further, the conductive paste is printed and coated on the ceramic green sheet by using a printing means such as a screen printing method.

Further, the plurality of ceramic green sheets which form the first insulation layer 7A to fifth insulation layer 7E are stacked, and the conductive paste and ceramic green sheets are simultaneously fired. Due to this, a dielectric 3 in which a pair of electrodes 9 are buried, that is, the plasma generator 1, is formed.

In the following description, the mode of operation of the plasma generator 1 will be explained.

When voltage is applied to the pair of electrodes 9, electric fields are formed in the through holes 3*h* of the dielectric 3. Discharge is started when the electric fields in the through holes 3*h* exceed a predetermined discharge start field intensity, whereupon plasma is generated. The generated plasma is for example utilized for reforming a gas, as a light source, or for generation of ion wind. Here, as understood from the above explanation, if an electric field having a high intensity is formed by a low voltage, plasma can be generated by a low voltage.

Figure 4A:
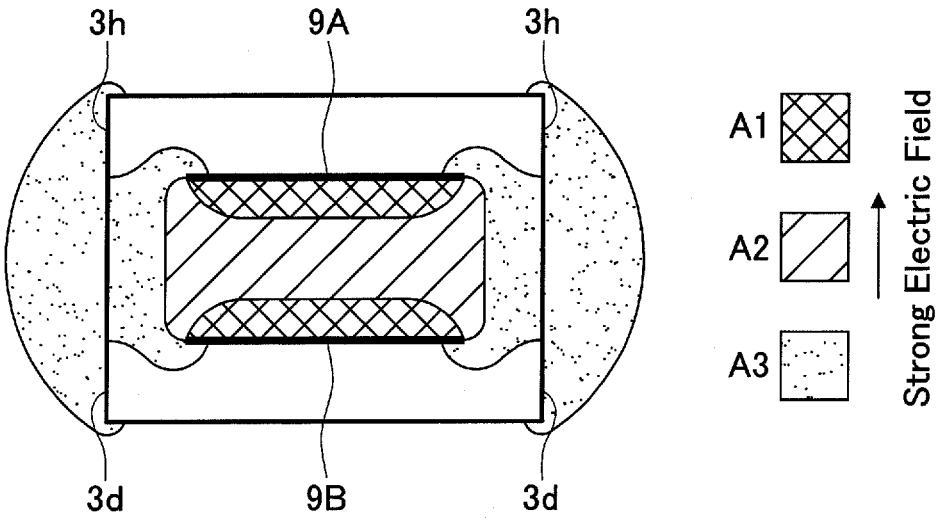
FIG. 4A and FIG. 4B are cross-sectional views which show distributions of field intensity of a comparative example and example according to the first embodiment.
Figure 4B:
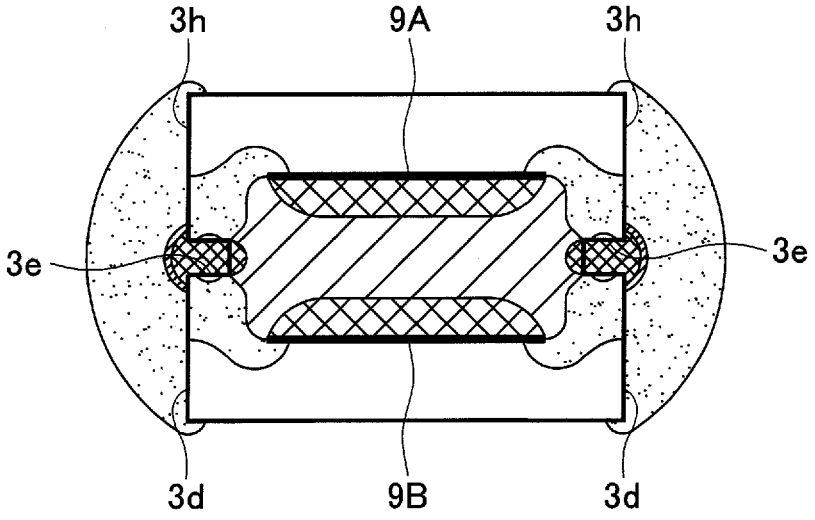

FIG. 4A is a view which shows the distribution of field intensity in a comparative example, and FIG. 4B is a view which shows the distribution of field intensity in the present embodiment.

In these diagrams, at the cross-sections having a bit broader range than in FIG. 3, distributions of electric fields having intensities A1 to A3 are indicated by different hatchings. Note that, intensity A1> intensity A2> intensity A3. These diagrams are prepared based on results of simulation when assuming that equal voltages are applied to the plasma generators in the comparative example and the embodiment.

The comparative example (FIG. 4A) shows the case where no recessed portions 3*e* are formed in the through holes 3*h*. In the comparative example, electric fields having an intensity A1 are caused near the facing surfaces of the electrodes 9, an electric field having an intensity A2 is caused near the center between the pair of electrodes 9, and electric fields having an intensity A3 are caused in a range from the electrodes 9 to the inner circumferential surface 3*d* and near the inner circumferential surface 3*d* (in the through holes 3*h*). Accordingly, in the comparative example, for generation of plasma, in other words, for the electric field out of the dielectric 3 (in the through holes 3*h*) exceeding the discharge start intensity, the intensity A3 must exceed the discharge start intensity.

On the other hand, in the embodiment (FIG. 4B), in the recessed portions 3*e* (outside of dielectric 3), electric fields having intensity A1 are caused. This is because the dielectric constant is lower in the recessed portions 3*e* than that around them (dielectric 3), therefore electric field concentration occurs. As a result, in the embodiment, the intensity A1 may exceed the discharge start intensity. That is, compared with the comparative example, the voltage to be applied to the pair of electrodes 9 can be made lower.

According to the above embodiment, the plasma generator 1 has the dielectric 3 having the inner circumferential surface 3*d* and a pair of electrodes 9 which are arranged separated from each other in the direction along the inner circumferential surface 3*d* and are isolated from each other by the dielectric 3 and which are capable of generating plasma on the inner circumferential surface 3*d* by application of voltage. Further, in the inner circumferential surface 3*d*, at the positions between the pair of electrodes 9 in a plan view, recessed portions 3*e* for causing electric field concentration are formed.

Accordingly, as explained with reference to FIG. 4B, by utilizing the electric field concentration, the applied voltage necessary for generation of plasma can be made lower. As a result, for example, the consumed power can be reduced.

In the dielectric 3, a plurality of through holes 3*h* passing through it in a predetermined direction (up/down direction on the sheet of FIG. 1A) are formed. The pair of electrodes 9 are provided in the dielectric 3 so as to face each other in the predetermined direction and have a plurality of openings 9*h* formed at positions which correspond to the plurality of through holes 3*h* and are capable of generating plasma in the through holes 3*h* by application of voltage. Further, a plurality of recessed portions 3*e* are formed in the inner circumferential surfaces of the plurality of through holes 3*h*.

Accordingly, the plasma generator 1 is configured so that plasma can be generated at a plurality of points by the pair of electrodes 9, so can efficiently generate plasma. By formation of recessed portions 3*e* in the plasma generator 1 having such a configuration so as to lower the voltage, plasma can be extremely efficiently generated.

The pair of electrodes 9 are buried in the dielectric 3. The recessed portions 3*e* are closed bottom recessed portions with a depth D thereof not more than the depth T from the inner circumferential surface 3*d* up to the pair of electrodes 9.

Accordingly, the place where the electric field concentration occurs is near the inner circumferential surface 3*d*, so it is made easy to cause generation of plasma at the inner circumferential surface 3*d* (in the through holes 3*h*). As a result, for example, compared with the case where the depth D is very large, the ratio of plasma which can contribute to the reforming of gas flowing in the through holes 3*h* can be made larger. Further, compared with the case where the depth D is large, the consumed power can be made smaller as well.

(Examples According to First Embodiment)

In the plasma generator 1 of the first embodiment, the field intensities when changing the width W and depth D were calculated.

The calculation conditions when changing the width W were as follows. Note that, notations which show various dimensions will be shown in FIG. 3.

Material of dielectric 3: Ceramic

Thickness H of dielectric 3 (plasma generator 1): about 1.0 mm

Depth T from inner circumferential surface 3*d* to electrodes 9: 0.25 mm Depth D of recessed portions 3*e:* 0.15 mm Inter-electrode distance S: 0.5 mm Width W of recessed portions 3*e:* 0.5 mm, 0.3 mm, or 0.1 mm The maximum values (calculated values) of the field intensity E when the width W had the above values were as follows.

| W (mm) | E (kV/mm) |
|---|---|
| 0.5 | 1.2 |
| 0.3 | 1.8 |
| 0.1 | 2.6 |

Figure 5A:
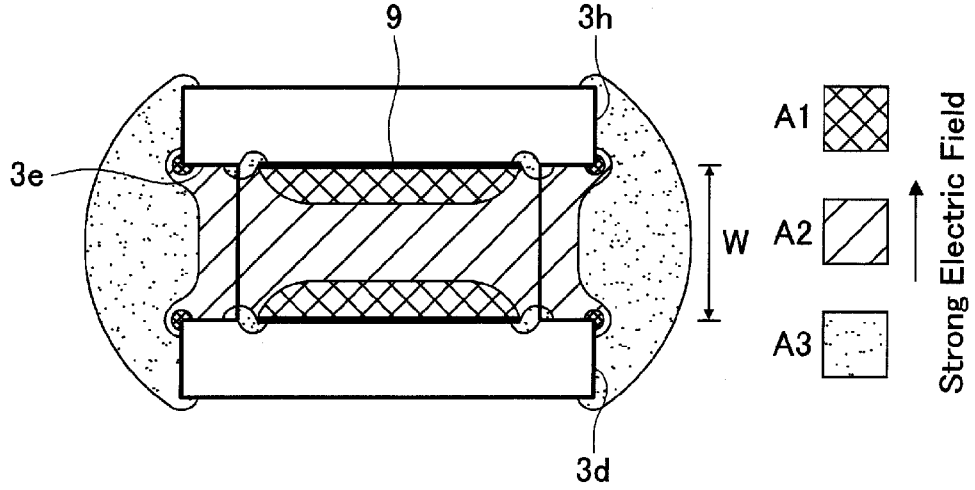
FIG. 5A to FIG. 5C are cross-sectional views which show distributions of field intensity in examples according to the first embodiment.
Figure 5B:
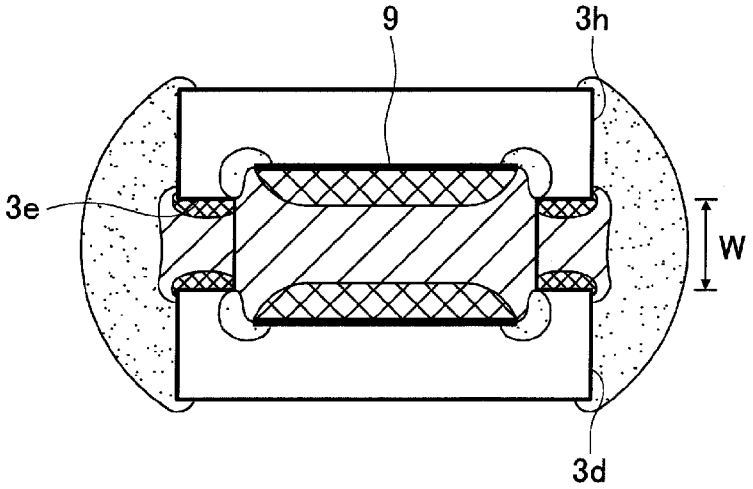
Figure 5C:
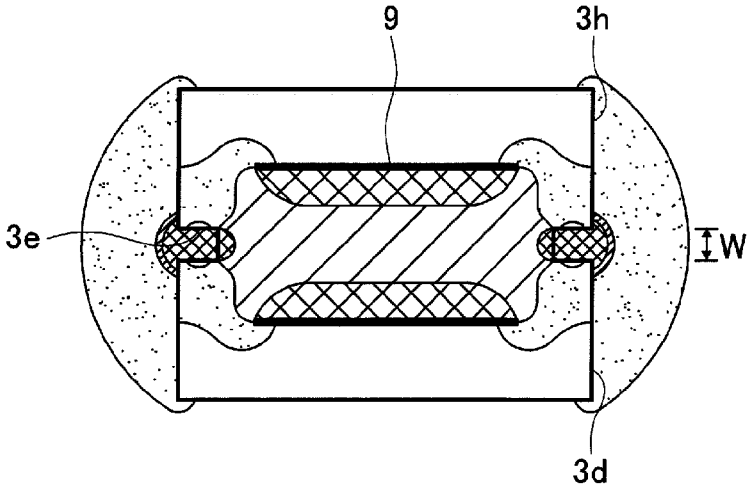

Further, FIG. 5A to FIG. 5C are cross-sectional views the same as FIG. 4B which show the distributions of field intensity in the above calculation results. FIG. 5A to FIG. 5C correspond to the cases when the width W are 0.5 mm, 0.3 mm, and 0.1 mm.

It was seen from the above calculation values and FIG. 5 that the field intensity improved as the width W was smaller. Further, it was confirmed that the electric field having the intensity A2 which was present only in the dielectric 3 in the comparative example in FIG. 4A was present also in the recessed portions 3*e* (outside of dielectric 3) in FIG. 5A, and the effect of electric field concentration was obtained even when the width W was equal to the inter-electrode distance S.

Accordingly, as the upper limit value (on broad side) of the preferred range of the width W, there can be mentioned the value equal to the inter-electrode distance S which was confirmed to have the electric field concentration effect. Note that, this upper limit value is proper also from the fact that basically a strong electric field is formed between the electrodes 9.

Further, in theory, the lower limit value (on narrow side) of the preferred range of the width W is preferably as narrow as possible. Note, in actuality, the minimum value of the width W is defined by the machining accuracy. As an example, the machining accuracy of a laser is about 10 μm.

Next, the calculation conditions when changing the depth D were as follows.

Material of dielectric 3: Ceramic

Thickness H of dielectric 3 (plasma generator 1): about 1.0 mm

Depth T from inner circumferential surface 3*d* to electrodes 9: 0.25 mm Depth D of recessed portions 3*e:* 0.20 mm, 0.15 mm, 0.10 mm Inter-electrode distance S: 0.3 mm Width W of recessed portions 3*e:* 0.1 mm The maximum values (calculated values) of the field intensity E when the depth D had the above values were as follows.

| D (mm) | E (kV/mm) |
|---|---|
| 0.20 | 3.1 |
| 0.15 | 3.2 |
| 0.10 | 2.7 |

Figure 6A:
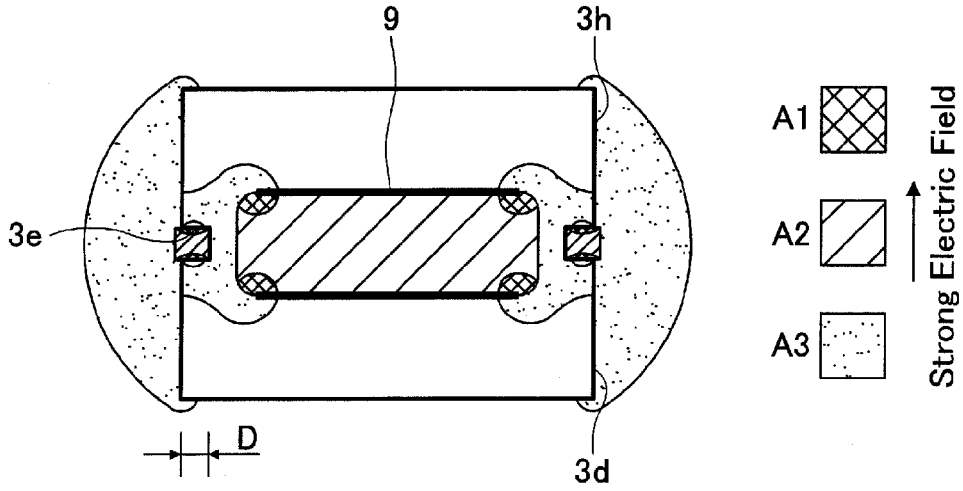
FIG. 6A to FIG. 6C are cross-sectional views which show distributions of field intensity in other examples according to the first embodiment.
Figure 6B:
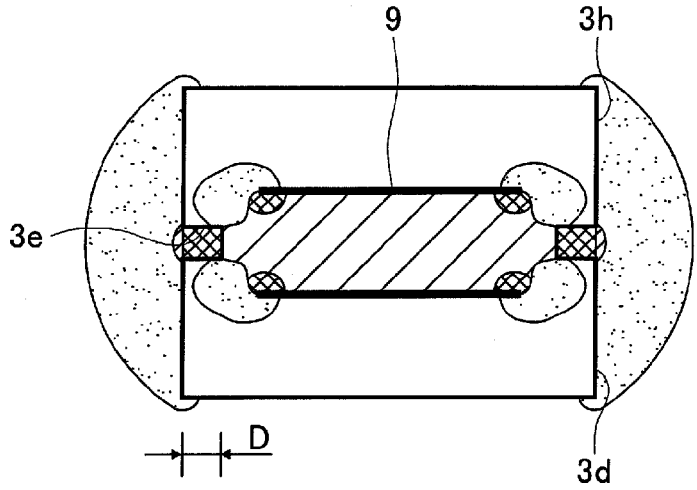
Figure 6C:
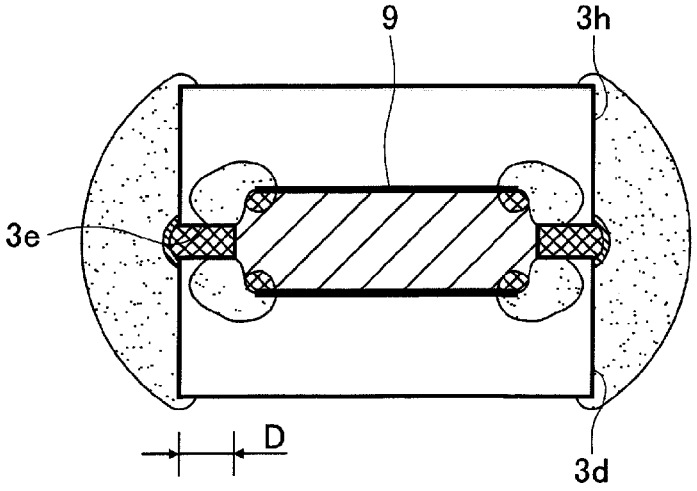

Further, FIG. 6A to FIG. 6C are cross-sectional views the same as FIG. 4B which show the distributions of field intensity in the above calculation results. FIG. 6A to FIG. 6C correspond to the cases when the depth D are 0.20 mm, 0.15 mm, and 0.10 mm.

Regarding the maximum value described above, the value when the depth D was 0.15 mm became a bit larger than the value when the depth D was 0.20 mm, but the distribution of intensity A1 became broader in FIG. 6C than that in FIG. 6B. Accordingly, basically, it was seen that the field intensity improved more as the depth D was larger. Further, it was confirmed that the electric field having intensity A2 which was present only in the dielectric 3 in the comparative example in FIG. 4A was present also in the recessed portions 3*e* (outside of dielectric 3) in FIG. 6A, and the effect of electric field concentration was obtained if the recessed portions 3*e* were formed even when the depth was small.

Accordingly, this means that the upper limit value (on deep side) of the preferred range of the depth D is preferably as deep as possible if speaking from only the viewpoint of the field intensity. Note, as explained above, when considering the plasma to be generated near the inner circumferential surfaces 3*d* of the through holes 3*h*, and so on, as the upper limit value of the preferred range of the depth D, a value equal to the depth T from the inner circumferential surfaces 3*d* up to the electrodes 9 can be mentioned.

Further, the lower limit value (shallow side) of the preferred range of the depth D may be small in theory. Note, in the same way as the width W, the minimum value of the width W is defined according to the machining accuracy (for example 10 μm).

<Second Embodiment>

Figure 7A:
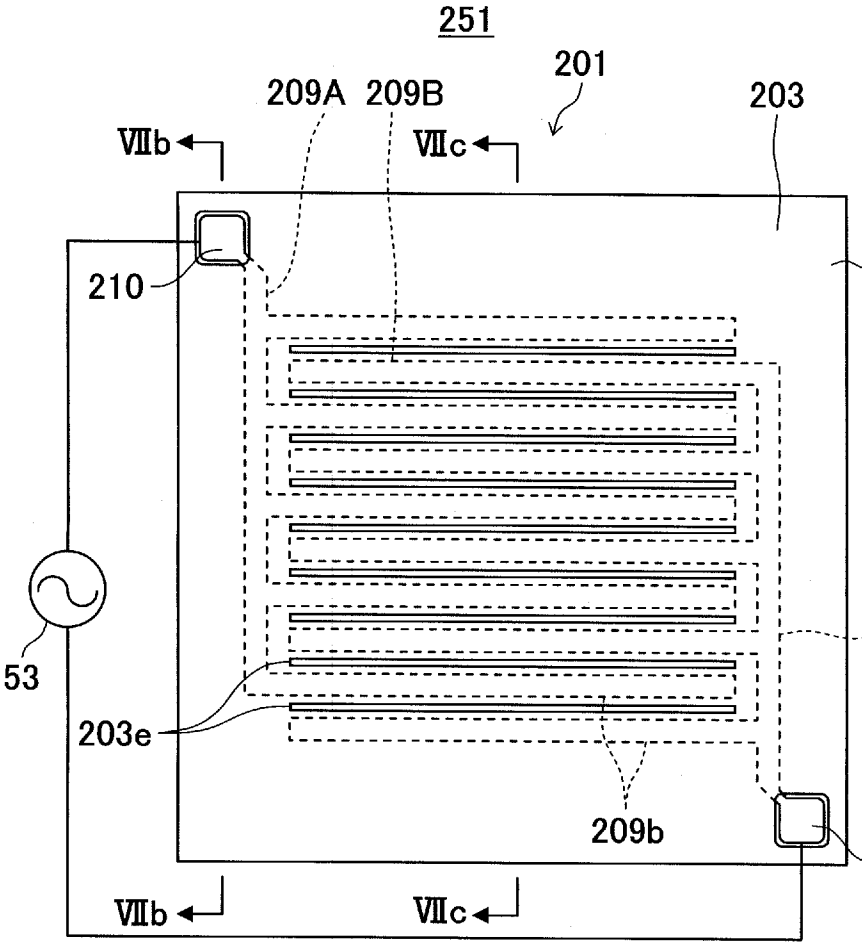
FIG. 7A is a plan view which shows a plasma generator of a second embodiment.
Figure 7B:
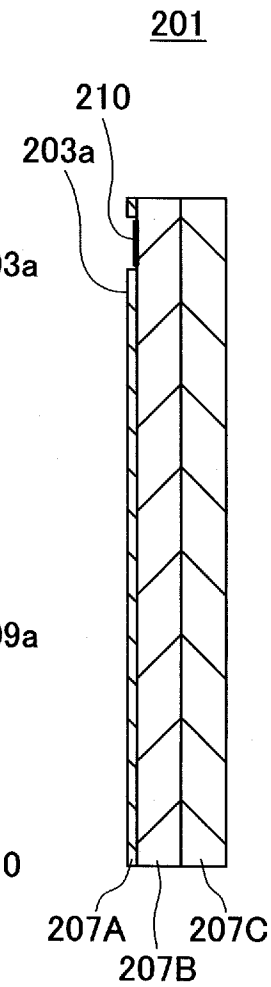
FIG. 7B is a cross-sectional view which is taken along a line VIIb-VIIb in FIG. 7A.
Figure 7C:
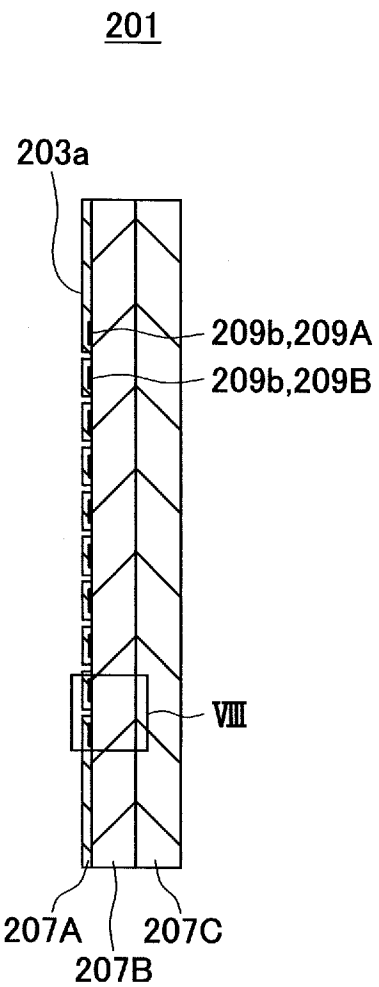
FIG. 7C is a cross-sectional view which is taken along a line VIIc-VIIc in FIG. 7A.

FIG. 7A is a plan view which shows a plasma generator 201 (plasma generating device 251) of a second embodiment, FIG. 7B is a cross-sectional view which is taken along a line VIIb-VIIb in FIG. 7A, and FIG. 7C is a cross-sectional view which is taken along a line VIIc-VIIc in FIG. 7A.

The plasma generator 201 has a dielectric 203 and a first electrode 209A and a second electrode 209B buried in the dielectric 203. The plasma generator 201 is configured causing generation of plasma on a major surface 203*a* of the dielectric 203.

The dielectric 203 is for example formed in a roughly thin parallelepiped shape as a whole. Note that, the planar shape of the dielectric 203 may be suitably set. However, FIG. 7A exemplifies a case of a rectangle. The dielectric 203 is formed by lamination of a plurality of insulation layers 207 in the same way as the dielectric 3 in the first embodiment. The number of the plurality of insulation layers 207 and the thickness of each insulation layer 207 may be suitably set in accordance with the position of arrangement of the electrodes 209 and so on. Further, the material of each insulation layer 207 may be the same as that in the first embodiment.

The pair of electrodes 209 are layer shaped electrodes which are arranged between the first insulation layer 207A and the second insulation layer 207B and are parallel to the major surface 203*a* of the dielectric 203. The planar shape of each electrode 209 is a comb shape. That is, each electrode 209 has a long base section 209*a* and a plurality of teeth 209*b* extending from the base section 209*a* in a direction intersecting (for example perpendicular with) the base section 209*a*. The pair of electrodes 209 are arranged so that they mesh with each other (so that their plurality of teeth 209*b* intersect with each other). Note that, the material of the electrodes 209 may be the same as that of the electrodes 9 in the first embodiment.

Terminals 210 are connected to the electrodes 209 and are exposed from openings formed in the first insulation layer 207A. Further, the pair of terminals 210 are supplied with AC voltage by the power source 53.

Figure 8:
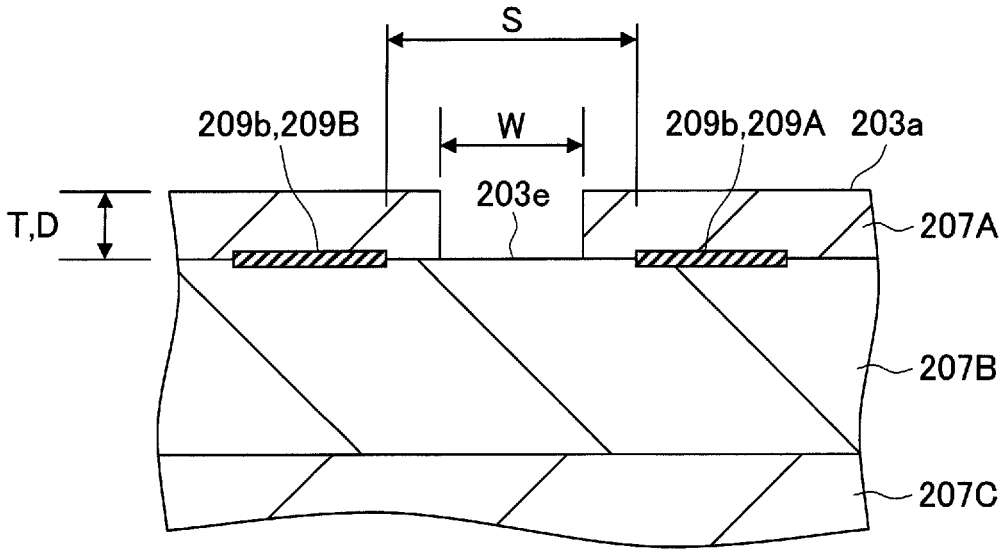
FIG. 8 An enlarged view of a region VIII in FIG. 7C.

FIG. 8 is an enlarged view of a region VIII in FIG. 7C.

As shown in FIG. 7A and FIG. 8, in the major surface 203*a* of the dielectric 203, recessed portions 203*e* are formed at positions between the first electrode 209A and the second electrode 209B in a plan view. The recessed portions 203*e* are for example formed in groove shapes as shown in FIG. 7A between the teeth 209*a* of the first electrode 209A and the teeth 209*b* of the second electrode 209B so as to extend along these teeth. The recessed portions 203*e* are for example configured by through holes formed in the first insulation layer 207A covering the electrodes 209. The depth D thereof is substantially equal to the depth T from the major surface 203*a* of the dielectric 203 to the electrodes 209.

Note that, the depth D can be adjusted within a range up to the depth T by covering the electrodes 209 by a plurality of insulation layers 207 and forming through holes in only a portion of the insulation layers 207 among them. Further, it can be adjusted within a range over the depth T by forming through holes in the insulation layers 207 (for example 207B) on the opposite side to the major surface 203*a* from the electrodes 209. It is also possible to etch the dielectric 203 up to a suitable depth by a laser or the like to control the depth D to any depth. Needless to say the width W can be adjusted to a suitable size by etching or the like.

The method of formation of the plasma generator 201 may be the same as that in the first embodiment. That is, it is possible to print conductive paste which forms the electrodes 209 on ceramic green sheets which form the insulation layers 207 and fire the stacked ceramic green sheets to thereby form the dielectric 203 having electrodes 209 buried therein.

According to the above second embodiment, the plasma generator 1 has the dielectric 203 having the major surface 203*a* (predetermined surface) and the pair of electrodes 209 which are arranged separated from each other in a direction along the major surface 203*a* and isolated from each other by the dielectric 3 and are capable of generating plasma on the major surface 203*a* by application of voltage to them. In the major surface 203*a*, recessed portions 203*e* for causing electric field concentration are formed at positions between the pair of electrodes 209 when viewed on a plane.

Accordingly, in the same way as the first embodiment, by utilizing the electric field concentration, the applied voltage necessary for generation of plasma can be made lower.

The pair of electrodes 209 are formed in a layer state parallel to the major surface 203*a*.

Accordingly, the plasma generator 1 is configured to be easy to form by stacking the insulation layers as a whole. Further, application to a later explained plasma generator for generating an ion wind is facilitated as well.

The pair of electrodes 209 are formed so as to have comb-shaped planar shapes and are arranged to mesh with each other. The plurality of recessed portions 203*e* are formed at positions among the plurality of teeth 209*b* of the comb-shaped electrodes in a plan view of the major surface 203*a* so as to extend along the plurality of teeth 209*b*.

Accordingly, the plasma generator 201 is configured so that plasma can be generated at a plurality of points by the pair of electrodes 209, therefore plasma can be efficiently generated. Further, by lowering the voltage by formation of the recessed portions 203*e* in the plasma generator 201 having such a configuration, plasma can be extremely efficiently generated.

Note that, the recessed portions 203*e* may be provided among the plurality of teeth 209*b* as well in a form that extends in the longitudinal direction with a broken part in the middle. In other words, the recessed portions 203*e* may have be configured so that for example parts which are square shaped in a plan view line up along the tooth 209*b* around each one of the plurality of teeth 209*b*.

Example According to Second Embodiment

In the plasma generator 201 of the second embodiment, the field intensities when changing the width W and depth D were calculated.

The calculation conditions when changing the width W were as follows. Note that, notations which show various dimensions will be shown in FIG. 8.

Material of dielectric 203: Ceramic

Depth T from major surface 203*a* to electrodes 209: 0.10 mm

Depth D of recessed portions 203*e*: 0.1 mm

Inter-electrode distance S: 1.0 mm

Width W of recessed portions 203*e*: 0.1 mm, 0.2 mm, 0.3 mm, 0.4 mm, or 0.5 mm The maximum values (calculated values) of the field intensity E when the width W had the above values were as follows.

| W (mm) | E (kV/mm) |
|---|---|
| 0.1 | 1.2 |
| 0.2 | 1.2 |
| 0.3 | 1.1 |
| 0.4 | 1.0 |
| 0.5 | 0.9 |

Figure 9:
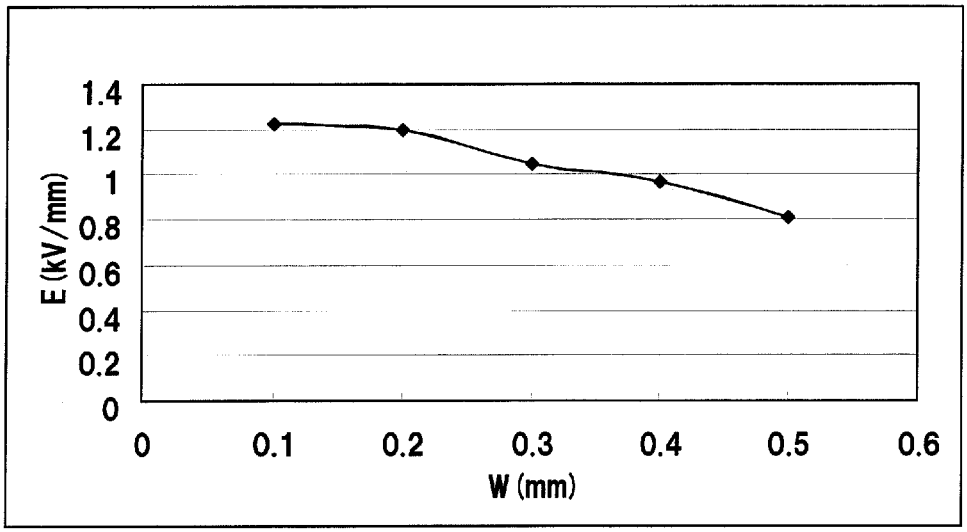
FIG. 9 A view which shows calculation values in examples according to the second embodiment.
Figure 10A:
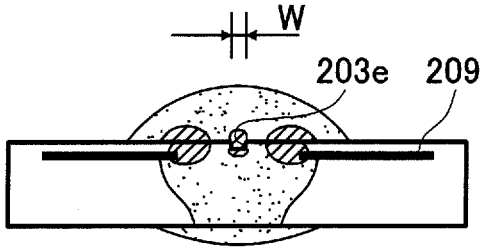
FIG. 10A to FIG. 10E are cross-sectional views which show distributions of field intensity in examples of the second embodiment.
Figure 10A:
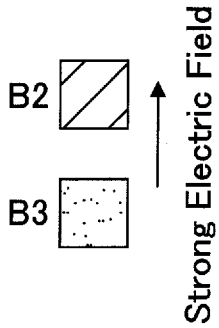
Figure 10B:
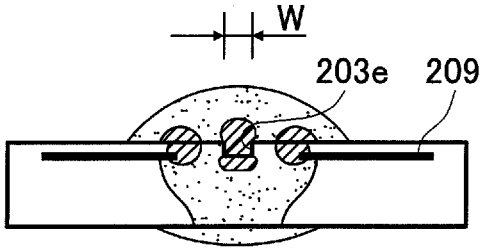
Figure 10C:
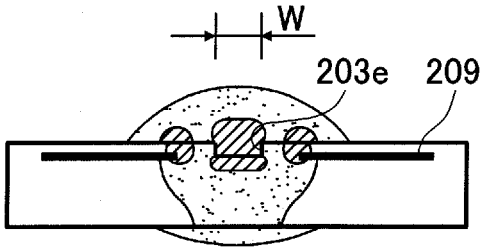
Figure 10D:
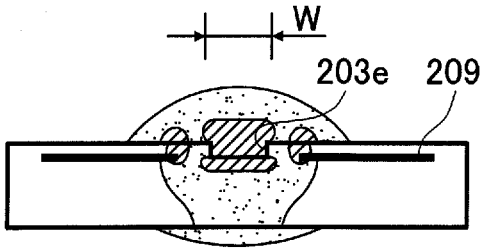
Figure 10E:
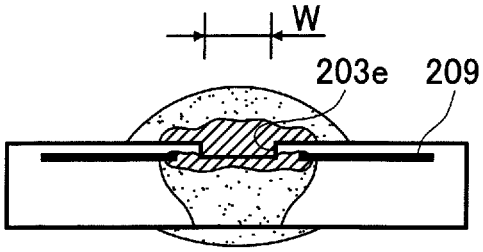

FIG. 9 is a view which shows the above calculated values, in which an abscissa shows the width W, and an ordinate shows the field intensity E. Further, FIG. 10A to FIG. 10E are cross-sectional views the same as FIG. 4 which show the distributions of field intensity in the above calculation results. Note, the ranges of field intensity corresponding to various hatchings are different from those in FIG. 4. The field intensities are intensity B1 (FIG. 12)>intensity B2>intensity B3. FIG. 10A to FIG. 10E correspond to the cases when the width W are 0.1 mm, 0.2 mm, 0.3 mm, 0.4 mm, and 0.5 mm.

It was seen from the above calculation values and FIG. 9 that the field intensity was improved more as the width W was smaller in the same way as the first embodiment. Further, it can be taken from FIG. 9 that, when the width W becomes larger than 0.2 mm, the effect of improvement of the field intensity falls more than that at the time when the width W is 0.1 mm or less.

In these examples, the effect of electric field concentration was confirmed in the range up to when the width W was up to a half of the inter-electrode distance S. However, from an analogy based on the examples of the first embodiment and from the fact that the electric field is basically formed strong between the electrodes 9, even in the second embodiment, a value equal to the inter-electrode distance S can be mentioned as the upper limit value (broad side) of the preferred range of the width W.

Further, as the upper limit value of the preferred range further narrowed in range, as explained above, the change of the effect of electric field concentration becomes different from the case when the width W is 0.2 mm, therefore a value about ⅕ of the inter-electrode distance S (1.0 mm) can be mentioned. Note that, in the examples in the first embodiment as well, at the case when the width W becomes about ⅕ (0.1 mm) of the inter-electrode distance S (0.5 mm), the effect of electric field concentration becomes conspicuous.

Further, the lower limit value (narrow side) of the preferred range of the width W is preferably as narrow as possible in theory. Note, in the same way as the first embodiment, in actuality, the minimum value of the width W is defined according to the machining accuracy (for example 10 μm).

Next, the calculation conditions when changing the depth D were as follows.

Material of dielectric 203: Ceramic

Depth T from major surface 203*a* to electrodes 209: 0.10 mm

Depth D of recessed portions 203*e:* 0.05 mm, 0.10 mm, 0.20 mm, 0.30 mm, 0.40 mm, 0.50 mm, 0.60 mm, penetration Inter-electrode distance S: 1.0 mm Width W of recessed portions 203*e:* 0.1 mm The maximum values (calculated values) of the field intensity E when the depth D had the above values were as follows.

| D (mm) | E (kV/mm) |
|---|---|
| 0.05 | 1.2 |
| 0.10 | 1.6 |
| 0.20 | 2.1 |
| 0.30 | 2.3 |
| 0.40 | 2.5 |
| 0.50 | 2.7 |
| 0.60 | 2.9 |
| Penetration | 2.9 |

Figure 11:
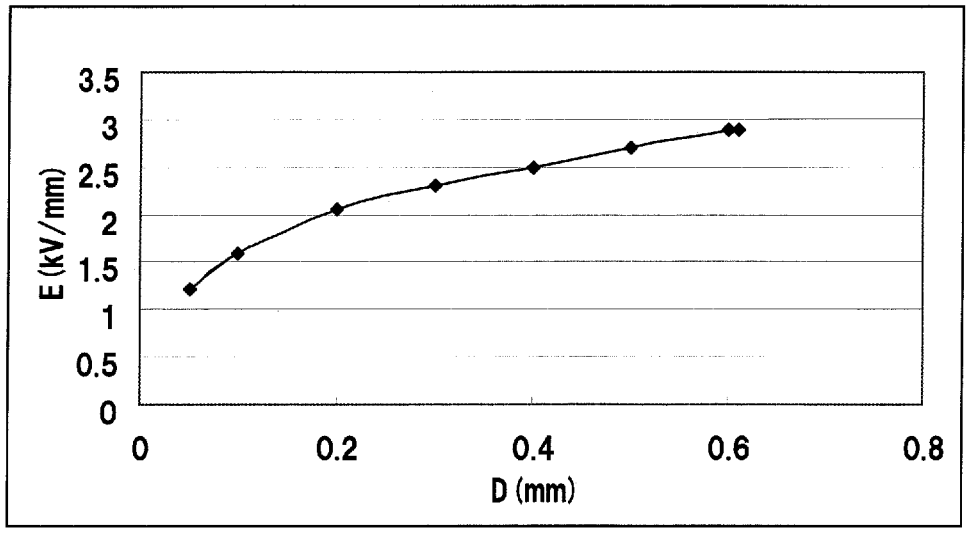
FIG. 11 A diagram which shows calculated values in other examples according to the second embodiment.
Figure 12A:
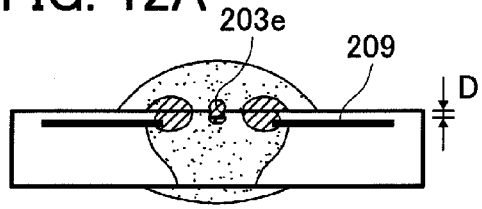
FIG. 12A to FIG. 12H are cross-sectional views which show distributions of field intensity of other examples according to the second embodiment.
Figure 12E:
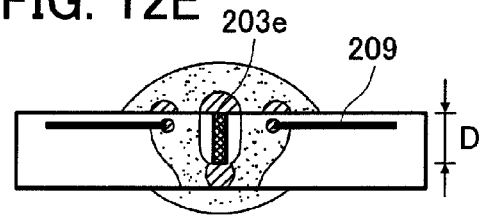
Figure 12B:
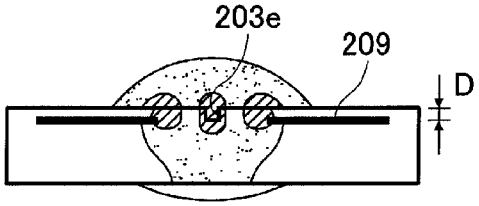
Figure 12F:
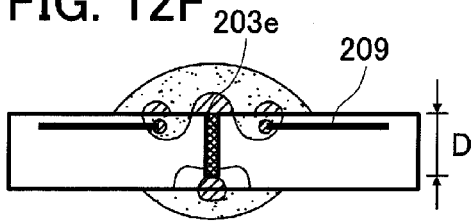
Figure 12C:
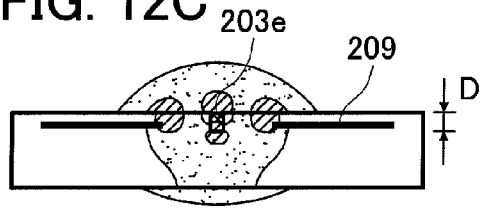
Figure 12G:
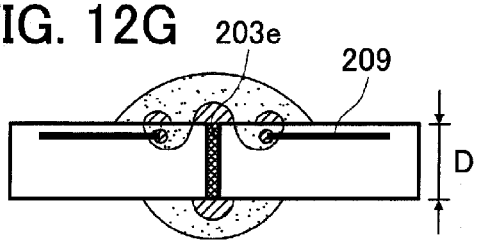
Figure 12D:
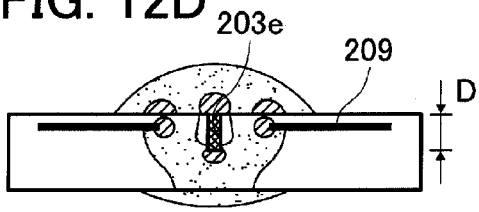
Figure 12H:
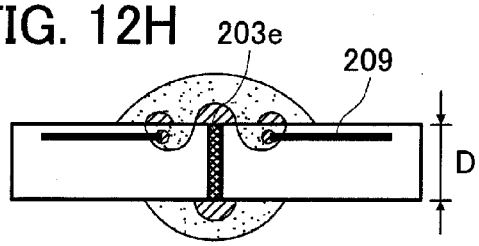
Figure 12H:
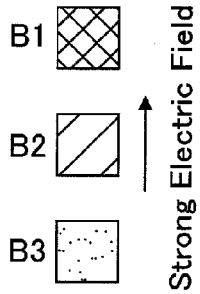

FIG. 11 is a view which shows the above calculation values, in which the abscissa shows the depth D, and the ordinate shows the field intensity E. Further, FIG. 12A to FIG. 12H are cross-sectional views the same as FIG. 10 which show the distributions of field intensity in the above calculation results. FIG. 12A to FIG. 12H correspond to the cases when the depth D are 0.05 mm, 0.10 mm, 0.20 mm, 0.30 mm, 0.40 mm, 0.50 mm, 0.60 mm, and penetration.

It was seen from the above calculation values and FIG. 11 that the field intensity is improved more as the depth D is deeper. Further, it is taken from FIG. 11 that the increase of the effect of improvement of field intensity becomes slower when the depth D exceeds 0.2 mm.

Accordingly, as the upper limit value (deep side) of the preferred range of the depth D, first, there can be mentioned a depth by which the recessed portions 203*e* which were confirmed to have the effect of electric field concentration penetrate through the bottoms. Further, a depth about two times (0.2 mm) of a depth T (0.1 mm) by which the increase of the electric field concentration becomes slower can be mentioned. Further, in the same way as the first embodiment, from the viewpoints of increasing the ratio of generation of plasma on the major surface 203*a* side and suppressing the consumed power, a value equivalent to the depth T can be mentioned.

Further, the lower limit value (shallow side) of the preferred range of the depth D may be small in theory in the same way as the first embodiment. In actuality, it is defined according to the machining accuracy (for example 10 μm).

<Third Embodiment>

Figure 13:
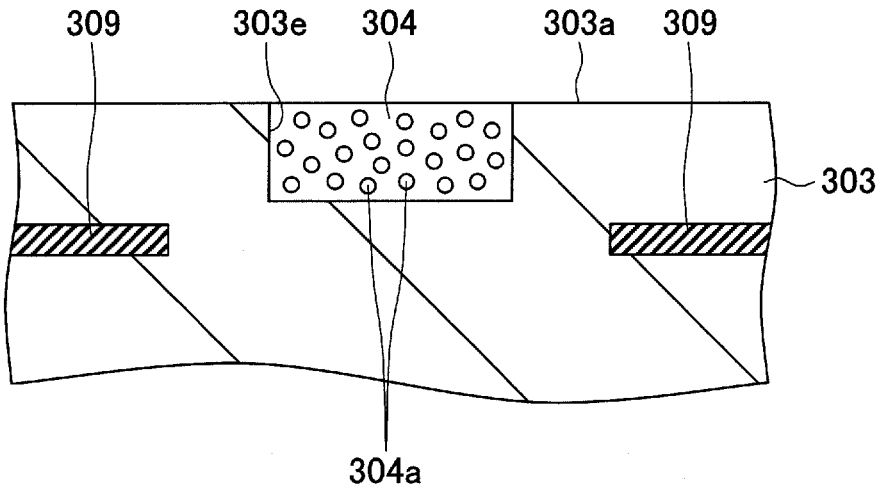
FIG. 13 A cross-sectional view which shows principal parts of a plasma generator according to a third embodiment.

FIG. 13 is a cross-sectional view which show principal parts of a plasma generator 301 of a third embodiment.

The plasma generator 301, in the same way as the first and second embodiments, has a dielectric 303 having a predetermined surface 303*a* and a pair of electrodes 309 which are arranged separated from each other in the direction along the predetermined surface 303*a* and are isolated from each other by the dielectric 303 and which are capable of generating plasma on the predetermined surface 303*a* by application of voltage to that. Further, in the predetermined surface 303*a*, recessed portions 303*e* causing electric field concentration are formed at positions between the pair of electrodes 309 in a plan view.

Note, a porous material is filled in the recessed portions 303*e*. Inside the porous material 304, a plurality of voids 304*a* are formed. The plurality of voids 304*a* are communicated by connection of adjacent ones. Further, the voids 304*a* positioned on the predetermined surface 303*a* side are opened at the predetermined surface 303*a*. Note that, it is also possible to grasp the plurality of voids 304*a* as recessed portions formed in the predetermined surface 303*a*.

The porous material 304 is formed by for example a ceramic or another insulating material. Note, preferably the porous material 304 is formed by a material having a lower dielectric constant than the dielectric 303.

According to the above third embodiment, because of the dielectric constant of the material of the porous material 304 being lower than the dielectric constant of the dielectric 303 and/or the dielectric constant being lowered in the plurality of voids 304*a*, electric field concentration occurs in the recessed portions 303*e*. Accordingly, in the same way as the first and second embodiments, plasma can be generated at a low voltage.

<Fourth Embodiment>

Figure 14:
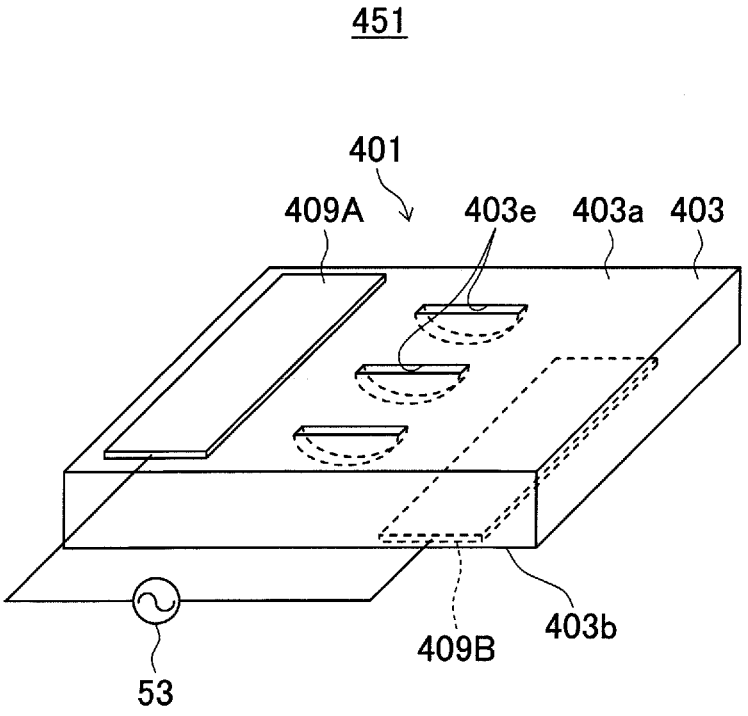
FIG. 14 A perspective view which shows a plasma generating device according to a fourth embodiment.

FIG. 14 is a perspective view which shows a plasma generating device 451 (plasma generator 401) of a fourth embodiment.

In the plasma generator 401, a first electrode 409A is superposed on one major surface 403*a* of the flat plate-shaped dielectric 403, and a second electrode 409B is superposed on the other major surface 403*b*. Further, the first electrode 409A and second electrode 409B are arranged with a space from each other when viewing the major surfaces 403*a* by a plan view. Then, when voltage is applied to the pair of electrodes 409 by the power source 53, discharge occurs on the major surface 403*a* and major surface 403*b*, and plasma is generated.

Accordingly, it can be said that the plasma generator 401, in the same way as the first and second embodiments, has a dielectric 403 having a major surface 403*a* (predetermined surface) and a pair of electrodes 409 which are arranged separated from each other in the direction along the major surface 403*a* and isolated from each other by the dielectric 403 and which are capable of generating plasma on the major surface 403*a* by application of voltage to that.

Further, in the major surface 403*a*, a plurality of recessed portions 403*e* are formed for causing electric field concentration. The plurality of recessed portions 403*e* are arranged in a direction intersecting with the direction in which the plurality of electrodes 409 face each other. In other words, the recessed portions 403*e* are divided into a plurality of sections in the intersection direction. Further, each recessed portion 403*e* is formed so that its first electrode 409A side and second electrode 409B side become shallow.

According to such recessed portions 403*e*, by suitable control of the power source 53, at the time when an ion wind which flows on the major surface 403*a* from the first electrode 409A side to the second electrode 409B side is caused or when plasma is moved from the first electrode 409A side to the second electrode 409B side by a suitable blowing apparatus, occurrence of fluid resistance in the recessed portions 403*e* is suppressed.

The plurality of embodiments explained above may be suitably combined.

For example, the recessed portions 3*e* in the first embodiment may penetrate the bottom like the recessed portions 203*e* exemplified in the example of the second embodiment. That is, the recessed portions 3*e* may communicate the through holes 3*h* to each other (recessed portions without bottoms, continuous holes) as well.

Further, for example, the recessed portions 3*e* in the first embodiment may be formed shallow on one side or two sides in the direction of penetration of the through holes 3*h* as in the fourth embodiment so as to reduce the fluid resistance in the penetration direction in the through holes 3*h* or may be formed in a dotted-line state to surround the through holes 3*h* (divided in the direction intersecting with the direction in which the pair of electrodes face each other). Note that, such deformation is possible by suitably adjusting the thickness and number of the insulation layers 7 and the planar shape of the through holes 7*h*.

Further, for example, the porous material 404 in the third embodiment may be arranged in the recessed portions of the first, second, and fourth embodiments as well.

The present invention is not limited to the above embodiments and may be executed in various ways.

The shape of the dielectric and the shape of the electrodes are not limited to those exemplified in the embodiments. For example, the dielectric may be a tubular one and the electrodes may be ones generating plasma on the inner circumferential surface or outer circumferential surface of that tube. Further, for example, the electrodes are not limited to flat plate shaped ones and may be shaft shaped ones.

Three or more electrodes may be provided as well. For example, electrodes given a potential different from that for one electrode may be provided on the two sides of the one electrode. For example, in the first embodiment, on the side opposite to the first electrode 9A relative to the second electrode 9B, a third electrode given the same potential as that for the first electrode 9A may be provided as well. Note that, in the second embodiment, the teeth 209*b* excluding the base section 209*a* may be grasped as three or more electrodes as well.

It is not always necessary to provide the electrodes in the dielectric. The pair of electrodes need only be arranged so that they are separated from each other in a plan view of a predetermined surface of the dielectric and are isolated from each other by the dielectric and can generate plasma on the predetermined surface. For example, electrodes held by other members may be positioned at the two edge parts of the dielectric 403 in the fourth embodiment as well. However, if the electrodes are provided in the dielectric, the plasma generator becomes simpler. Further, in a plasma generator where the electrodes are buried in the dielectric, the effect of electric field concentration by the recessed portions becomes more conspicuous. Note that, an embodiment where electrodes which are arranged on the surface of a dielectric are coated by a dielectric material may be grasped as one where the electrodes are buried in a dielectric (including the dielectric material of the coating) as well.

A plurality of recessed portions may be provided between a pair of electrodes as well. In this case, the plurality of recessed portions may be distributed in a direction intersecting the direction in which a pair of electrodes face each other as in the fourth embodiment, and/or may be distributed in a direction in which a pair of electrodes face each other. By provision of a plurality of recessed portions, for example, easier generation of plasma in a broad range is expected.

Further, in the recessed portions, the corner portions on the upper end (the corner portions formed by the inner side surface of the recessed portions and the predetermined surface of the dielectric) may be formed in an arc shaped when viewed in a cross-section (may be chamfered) as well. In this case, mechanical breakage such as cracks in the corner portion are suppressed.

REFERENCE SIGNS LIST

1 . . . plasma generator, 3... dielectric, 3*d* . . . inner circumferential surface, 3*e* . . . recessed portion, and 9 . . . electrode.

The invention claimed is:

1. A plasma generator comprising:

a dielectric having a predetermined surface and a pair of electrodes which are arranged separated from each other in a direction along the predetermined surface and are isolated from each other by the dielectric and which are capable of generating plasma on the predetermined surface when a voltage is applied thereto, wherein the predetermined surface is provided with a recessed portion at a position between the pair of electrodes in a plan view, the recessed portion is closed at the bottom and has a depth not more than the depth from the predetermined surface to the pair of electrodes, the dielectric is provided with a plurality of through holes which pass through it in a predetermined direction, the pair of electrodes are provided in the dielectric so as to face each other in the predetermined direction and have a plurality of openings which are formed at positions which correspond to the plurality of through holes and can generate plasma in the plurality of through holes when a voltage is applied thereto, and a plurality of the recessed portions are provided in the predetermined surface constituted by inner circumferential surfaces of the plurality of through holes.

2. The plasma generator as set forth in claim 1, wherein the pair of electrodes are buried in the dielectric.

3. The plasma generator as set forth in claim 1, further comprising a porous material in the recessed portion.

4. A plasma generating device comprising:

the plasma generator as set forth in claim 1, and a power source which is capable of generating plasma on the predetermined surface by applying a voltage to the pair of electrodes.

5. The plasma generator as set forth in claim 2, further comprising a porous material in the recessed portion.

* * * * *